United States Patent [19]

Dionne et al.

[11] 4,056,800

[45] Nov. 1, 1977

[54] MAGNETIC FIELD ALIGNING MEANS

[75] Inventors: Norman J. Dionne, Arlington Heights; Ernest C. Wettstein, Acton, both of Mass.

[73] Assignee: Raytheon Company, Lexington, Mass.

[21] Appl. No.: 639,745

[22] Filed: Dec. 11, 1975

[51] Int. Cl.[2] ..... H01F 3/08

[52] U.S. Cl. ..... 335/296; 425/DIG. 33

[58] Field of Search ..... 335/297, 296; 336/233; 425/3, 78, DIG. 33

[56] References Cited

U.S. PATENT DOCUMENTS

| | | | |
|---|---|---|---|
| 3,250,831 | 5/1966 | Hooper | 425/DIG. 33 |
| 3,555,621 | 1/1971 | Hara | 425/DIG. 33 |
| 3,619,866 | 11/1971 | Hofmann et al. | 425/DIG. 33 |

*Primary Examiner*—George Harris

*Attorney, Agent, or Firm*—John T. Meaney; Joseph D. Pannone; Harold A. Murphy

[57] ABSTRACT

An axially aligned pair of spaced bucking coils energized to produce respective magnetic fields having cooperating radial components in an annular gap between the coils, and magnetic means for enhancing the radial components of the fields in the annular gap.

10 Claims, 2 Drawing Figures

FIG. 1
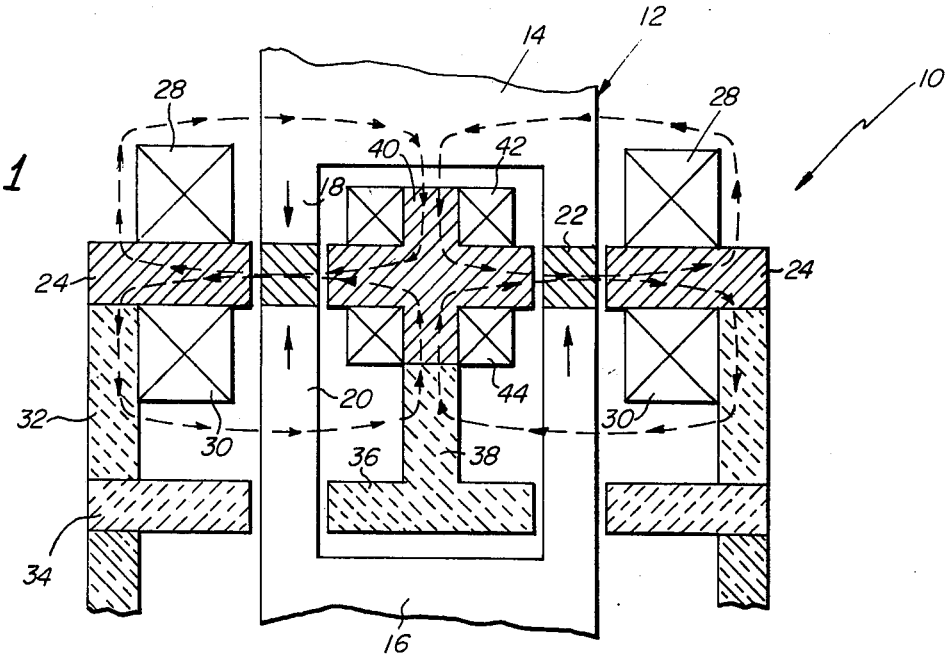
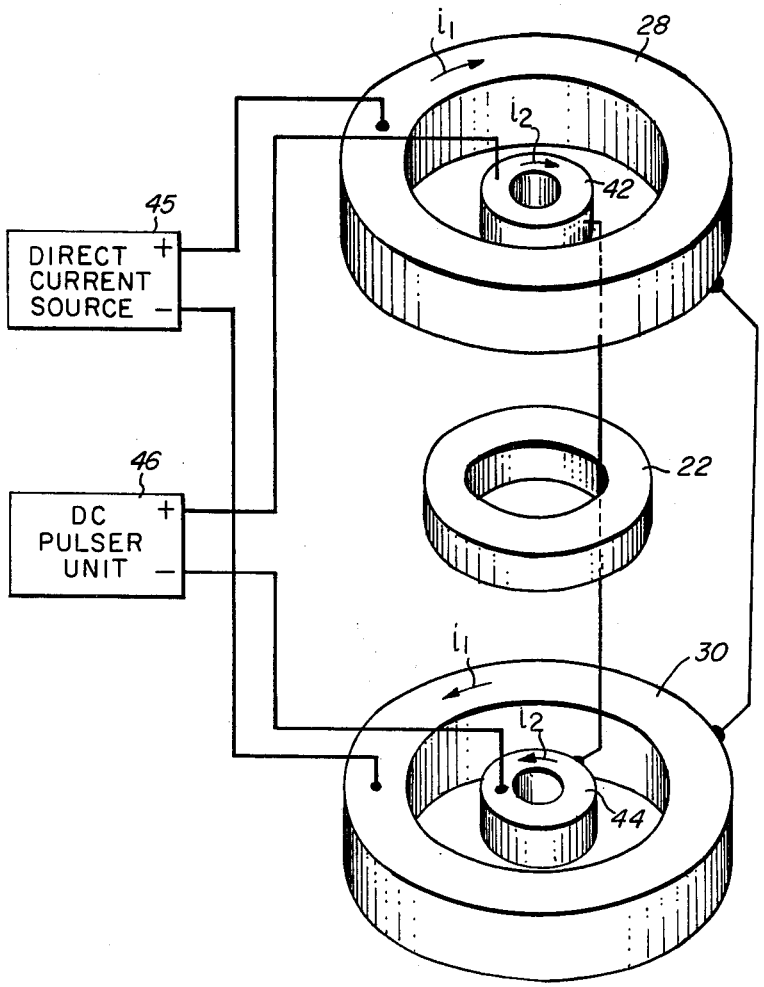
FIG. 2

MAGNETIC FIELD ALIGNING MEANS

BACKGROUND OF THE INVENTION

This invention relates generally to magnetic field producing means and is concerned more particularly with means for radially aligning powdered particles of annular magnetic devices.

Generally, in powder metallurgical fabrication of magnetic devices, such as by sintering, for example, suitable consitituent materials are mixed to produce a solid composite material, which then is comminuted to a fine powder. The powder particles may be compacted into a desired annular configuration by conventional means, while subjecting the particles to a radially directed magnetic field. After compacting, the packing density of the powder material may be about 75% of the theoretical maximum value, as determined by dividing the weight per unit volume by the density of the material. Subsequently, when the compacted device is heated to a suitable sintering temperature, the powder material undergoes shrinkage and further densification, whereby the packing density may increase to as much as 97% of the theoretical maximum value. As a result, the aligned powder particles are bonded to one another; and the magnetic properties of the composite material are greatly enhanced. Accordingly, when the annular device is magnetized in the direction of the particle alignment, a device having high magnetic coercivity and energy product is produced.

Thus, in order to produce a strong radially polarized magnet, it is necessary to align the maximum number of powder particles in the radial direction during the compacting operation. However, during compacting, it may be found that the intensity and shape of the particle aligning magnetic field, particularly above twenty kilogauss, for example, is severely limited by magnetic core saturation. As a result, a significant number of the powder particles may remain axially oriented; and the required high densification may not be achieved.

Therefore, it is advantageous and desirable to provide improved magnetic field aligning means for orienting powder particles in the radial direction during processing of an annular magnetic device.

SUMMARY OF THE INVENTION

Accordingly, this invention provides a magnetic field producing means comprising a first axially aligned pair of electromagnetic coils separated by an annular gap between the coils and encircling a second axially aligned pair of smaller diameter coils. The first pair of coils may be energized in bucking relationship to have respective cooperating field components in the annular gap. Also, the second pair of coils may be energized in bucking relationship to have respective radial field components which enhance or reenforce the radial field components of the first pair. Alternatively, the second pair of coils may be energized in bucking relationship to have respective radial field components which counteract the radial field components of the first pair. Thus, the second pair of smaller diameter coils provide means for shaping the magnetic field in the annular gap between the coils.

A Prefered embodiment comprises a compressing apparatus provided with an axially aligned pair of reciprocally movable rams having adjacent hollow end portions made of nonmagnetic material and separated by an annular gap wherein a die filled with magnetic powder material may be placed for compacting. The first pair of coils is positioned in external coaxial relationship with the respective hollow end portions of the rams; and the second pair of coils is disposed coaxially within the hollow end portions. A magnetic permeable member provides a low reluctance path axially through the coils and radially through the annular gap between the hollow end portions. When the member becomes magnetically saturated, it no longer is responsive to additional magnetic flux. However, the second pair of coils may be energized to produce respective magnetic fields having radial components which enhance the radial components of the field produced by the first pair of coils. Thus, the second pair of coils is energized to shape the magnetic field in the annular gap such that the maximum number of powder particles in the annular magnetic device are uniformly aligned in the radial direction.

BRIEF DESCRIPTION OF THE DRAWING

For a better understanding of this invention, reference is made, in the following more detailed description, to the accompanying drawing wherein:

FIG. 1 is a fragmentary axial view, partly in section, of a compressing apparatus provided with the radial field producing means of this invention; and FIG. 2 is an isometric view of the radial field producing means shown in FIG. 1 and energized in bucking relationship.

DESCRIPTION OF THE PREFERRED EMBODIMENT

Referring to the drawing wherein like characteristics of reference designate like parts, there is shown in FIG. 1 a magnetic powder compressing and aligning apparatus 10 including a press 12 which may be of the conventional type, such as Model HPM-100 made by Bussman Simetag of Munich, Germany, for example. The press 12 is provided with an axially aligned pair of cylindrical rams, 14 and 16, respectively, which have adjacent hollow end portions 18 and 20, respectively. The rams 14 and 15 are made of nonmagnetic material, such as stainless steel, for example, and are suitably supported for reciprocal axial movement toward and away from one another. In an annular gap between the respective end portions 18 and 20 is placed an annular magnetic device 22 made of fine powder magnetic material, such as rare earth-cobalt material, for example. The particles of fine powder material may be enclosed in a compressible casing (not shown) made of suitable nonmagnetic material, such as graphite, for example.

The device 22 is encircled by a ring-like die 24 made of magnetic permeable material, such as soft iron, for example. Suitably supported on opposing flat surfaces of the die 24 are respective solenoidal coils 28 and 30. The solenoidal coils 28 and 30 are disposed to encircle respective end portions 18 and 20 when the rams 14 and 16, respectively are compressing the device 22. The die 24 is supported by a nonmagnetic tubular member 32 which, in turn, is supported by a nonmagnetic base member 34. The support members 32 and 34 may be made of suitable nonmagnetic material, such as stainless steel, for example.

Disposed within the ram 16 is a cylindrical support member 36 made of nonmagnetic material, such as stainless steel, for example, and provided with a reduced diameter end portion 38. The end portion 38 supports in the plane of the device 22 a cylindrical core 40 made of magnetic permeable material, such as soft iron, for example. Opposing end portions of the core 40 are supported in the respective planes of the solenoidal coils 28 and 30, and are provided with annular recesses wherein respective smaller diameter solenoidal coils 42 and 44 are disposed.

As shown in FIG. 2, the larger diameter, solenoidal coil 28 may have an input terminal connected electrically to the positive terminal of a steady-state, unidirectional, current source, such as direct current source 45, for example. The output terminal of coil 28 may be connected electrically to the input terminal of the other larger diameter, solenoidal coil 30. The output terminal of coil 30, in turn, may be connected electrically to the negative terminal of direct current source 45. Thus, a steady-state, unidirectional current from source 45 may travel clockwise through coil 28 and counterclockwise through coil 28 and counterclockwise through coil 30, for example. Also, the smaller diameter, solenoidal coil 42 may have an input terminal of a pulsating, unidirectional current source, such as DC pulser unit 46, for example. Similarly, the output terminal of coil 42 may be connected electrically to the input terminal of the other smaller diameter coil 44. The output terminal of coil 44, in turn, may be connected electrically to the negative terminal of pulser unit 46. Accordingly, a unidirectional pulsating current from source 45 may travel clockwise through coil 42 and counterclockwise through coil 44, for example.

Thus, as shown in FIG. 1, the external, larger diameter coils 28 and 30, respectively, may be energized to produce respective bucking magnetic fields having radial extending components which cooperate with one another in the annular gap wherein the device 22 is disposed. The magnetic flux lines of these "coarse" magnetic fields extend through the magnetic permeable material of the core 44, which serves to straighten the lines in the radial direction. Consequently, the flux lines of the coarse magnetic fields pass radially through the fine powder material of the device 22 thereby substantially aligning the powder particles in the radial direction. The flux lines of the coarse magnetic fields then extend through the magnetic permeable material of the die 24 and loop around in respective directions to enter the core 44 to form respective closed paths.

However, when the current traveling through the larger diameter coils 28 and 30, respectively, is increased to intensify the associated coarse magnetic fields and provide a more uniform radial alignment of powder particles in device 22, it may be found that the magnetic permeable materials of core 44 and die 24 are saturated. As a result, the core 44 and die 24 no longer provide low reluctance paths to the flux lines of the coarse magnetic fields. In effect, the saturated materials of core 44 and die 24 function as high reluctance material, such as air, for example. Accordingly, the coarse magnetic fields of the larger diameter coils 28 and 30, respectively, cannot ensure that the fine powder particles of the device 22 will be uniformly aligned in the radial direction to provide greater densification.

However, in accordance with this invention, the smaller diameter coils may be pulsed to produce respective fine magnetic fields having radial components which enhance the radial components of the coarse magnetic fields in the annular gap wherein the device 22 is disposed. These fine magnetic fields produced by the smaller diameter coils, 42 and 44, respectively, provide the additional magnetic flux required for uniformly aligning the powder particles of device 22 in the radial direction. Also, the smaller diameter coils 42 and 44 are positioned to shape the increased magnetic field in the annular gap, such that the additional flux lines pass radially through the device 22, thereby aligning the powder particles thereof more uniformly in the radial direction. In this manner, the intensity and shape of the magnetic fields in the annular gap wherein the device 22 is disposed may be controlled as desired.

As a result, the rams 14 and 16, respectively, of press 12 are enabled to compact the fine powder material of device 22 more readily than conventional presses having only the coarse electromagnetic coils 28 and 30, respectively. Consequently, the press 10 with the additional fine electromagnetic coils 42 and 44, provides a greater particle and crystallographic alignment during the compacting of device 22. Accordingly, a higher packing density for a given intrinsic coercivity is achieved during a subsequent sintering operation due to the more uniform radial alignment of the fine powder particles in device 22.

Alternatively, the larger diameter pair of axially aligned coils 28 and 30 and the smaller diameter pair of axially aligned coils 42 and 44 may be connected to a common unidirectional current source. However, by using the described separate sources, 45 and 46, respectively, the smaller diameter pair of coils 42 and 44 may be energized by a current relatively stronger or weaker than the current passing through the larger diameter coils, and may be energized for a relatively longer or shorter time interval. Also, the smaller diameter coils 42 and 44 may be electrically connected to the associated pulser unit 46 so as to produce respective magnetic fields having radial components which oppose the radial components of magnetic fields produced by the associated coplanar, larger diameter coils 28 and 30, respectively.

From the foregoing, it may be seen that all of the objectives of this invention have been achieved by the method and apparatus described herein. However, it also will be apparent that various changes may be made by those skilled in the art without departing from the spirit of the invention as expressed in the appended claims. It is to be understood, therefore, that all matter shown and described herein is to be interpreted in an illustrative rather than in a limiting sense.

What is claimed is:

1. Magnetic field producing apparatus including:

a first pair of electromagnetic coils aligned with one another and axially spaced apart;

a ring of saturable magnetic material axially disposed between the electromagnetic coils of the first pair;

a cylinder of saturable magnetic material axially disposed within the ring and spaced therefrom by an annular gap;

first electrical means connected to the first pair of electromagnetic coils for producing respective magnetic fields having flux lines directed radially in the gap; and unidirectional flux modifying means including electromagnetic coil means axially disposed within the ring and annularly spaced therefrom for altering the magnetic field in the gap.

2. Magnetic field producing apparatus as set forth in claim 1 wherein the electromagnetic coil means includes a second pair of electromagnetic coils encircling the cylinder and axially spaced apart in the plane of the annular gap.

3. Magnetic field producing apparatus as set forth in claim 2 wherein the cylinder includes a radially projected annular portion disposed in the plane of the gap and between the coils of the second pair.

4. Magnetic field producing apparatus as set forth in claim 2 wherein the unidirectional flux modifying means includes second electrical means connected to the second pair of electromagnetic coils for producing respective magnetic fields and directing additional magnetic flux lines radially in the annular gap.

5. Magnetic field producing apparatus as set forth in claim 4 wherein the electromagnetic coils of the first pair are connected in electrical series and produce respective bucking magnetic fields having cooperating flux lines in the annular gap.

6. Magnetic field producing apparatus as set forth in claim 5 wherein the electromagnetic coils of the second pair are connected in electrical series and produce respective bucking magnetic fields having cooperating flux lines which increase the flux density in the annular gap.

7. Magnetic field producing apparatus as set forth in claim 5 wherein the ring and the cylinder are made of soft magnetic material.

8. Magnetic field producing apparatus as set forth in claim 6 wherein the first and second electrical means include respective sources of unidirectional current.

9. Magnetic powder compressing and aligning apparatus including:

an axially aligned pair of reciprocally movable rams having adjacent hollow end portions separated by an annular gap therebetween and made of nonmagnetic material;

a first axially aligned pair of electromagnetic coils disposed in external coaxial relationship with the hollow end portions of the rams;

a second axially aligned pair of electromagnetic coils disposed coaxially within the hollow end portions of the rams; and electrical means connected to the first and second pair of coils for producing respective magnetic fields having flux lines directed radially through the annular gap.

10. Magnetic powder compressing and aligning apparatus as set forth in claim 9 wherein an annular device made of magnetic powder material is disposed in the annular gap.

* * * * *